US012070116B1

(12) United States Patent
Lin

(10) Patent No.: US 12,070,116 B1
(45) Date of Patent: Aug. 27, 2024

(54) COSMETIC CONTAINER

(71) Applicant: LIBO COSMETICS CO., LTD., Taichung (TW)

(72) Inventor: Hsiao-Yun Lin, Taichung (TW)

( * ) Notice: Subject to any disclaimer, the term of this patent is extended or adjusted under 35 U.S.C. 154(b) by 0 days.

(21) Appl. No.: 18/195,941

(22) Filed: May 11, 2023

(51) Int. Cl.

| | |
|---|---|
| ***B43K 5/06*** | (2006.01) |
| ***A45D 40/02*** | (2006.01) |
| ***A45D 40/06*** | (2006.01) |
| ***A45D 40/20*** | (2006.01) |

(52) U.S. Cl.
CPC ..... *A45D 40/06* (2013.01); *A45D 40/02* (2013.01); *A45D 40/023* (2013.01); *A45D 40/205* (2013.01); *A45D 2040/207* (2013.01)

(58) Field of Classification Search
CPC .... A45D 40/205; A45D 40/02; A45D 40/023; A45D 2040/207
USPC ..... 401/179
See application file for complete search history.

(56) References Cited

U.S. PATENT DOCUMENTS

| | | | | |
|---|---|---|---|---|
| 6,702,158 | B2 * | 3/2004 | Kageyama | A45D 34/042 222/386 |
| 7,086,796 | B2 * | 8/2006 | Severa | A61M 35/003 401/179 |
| 10,532,376 | B2 * | 1/2020 | Zhang | B05C 17/0133 |

FOREIGN PATENT DOCUMENTS

| | | | | |
|---|---|---|---|---|
| FR | 3104392 | A1 * | 6/2021 | A45D 40/14 |

* cited by examiner

*Primary Examiner* — Jennifer C Chiang
(74) *Attorney, Agent, or Firm* — Bruce Stone LLP; Joseph A. Bruce

(57) ABSTRACT

A cosmetic container includes a threaded rod, a sleeve, a nut, a ratcheted wheel, a shell, a lining and a button. The nut is connected to the sleeve and inserted in the shell so that they are not allowed to translate or rotate relative to one other. The threaded rod is engaged with the nut. The shell is connected to the sleeve so that they are not allowed to translate or rotate relative to each other. The ratcheted wheel is movably inserted in the shell. The lining is inserted in the shell so that they are not allowed to translate or rotate relative to each other. The button is partially inserted in the lining so that they are not rotatable but translatable relative to each other. Every time the button is pushed, a cosmetic product is extended from the sleeve by the threaded rod.

15 Claims, 11 Drawing Sheets

COSMETIC CONTAINER

BACKGROUND OF INVENTION

1. Field of Invention

The present invention relates to a cosmetic container and, more particularly, to a container including a button operable to extend a lipstick from the container.

2. Related Prior Art

A lipstick is used to moisturize a lip so that the lip shines and renders a face beautiful and sexy. Lipstick is the most popular cosmetics.

Conventionally, a user rotates a handle of a container in a first sense of direction to extend a lipstick from the container or in a second sense of direction to withdraw the lipstick into the container. It is difficult to use the lipstick if too short a section of the lip stick is extended from the container. In this case, the user further rotates the handle in the first sense of direction to extend the lipstick from the container. It is easy to bent and break the lipstick if too long a section of the lipstick is extended from the container. The user rotates the handle in the second sense of direction to withdraw the lipstick into the container. It is however difficult to extend a proper section of the lipstick from the container.

The present invention is therefore intended to obviate or at least alleviate the problems encountered in the prior art.

SUMMARY OF INVENTION

It is an objective of the present invention to provide a precision cosmetic container.

To achieve the foregoing objective, the cosmetic container includes a shell, stationary ratchets, a sleeve, a nut, a threaded rod, a ratcheted wheel and a button. The stationary ratchets are attached to the internal face of the shell. The sleeve is non-movably connected to the shell. The nut is non-movably inserted in the shell. The non-circular threaded rod is engaged with the nut. The ratcheted wheel is movable in the shell and includes a non-circular aperture and ratchets. The non-circular aperture receives the non-circular threaded rod so that the ratcheted wheel is not rotatable but translatable relative to the non-circular threaded rod. The ratchets of the ratcheted wheel are engageable with the stationary ratchets. The button includes teeth formed at an end of a tube not rotatable but translatable in the shell. The teeth are engaged with the ratchets of the ratcheted wheel. Every time the button is pushed, the teeth push and disengage the ratchets of the ratcheted wheel from the stationary ratchets to allow the teeth of the ratcheted wheel to slide on the teeth so that the ratcheted wheel is translated and rotated in the shell, thereby rotating and translating the non-circular threaded rod relative to the nut to extend a cosmetic product from the sleeve.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
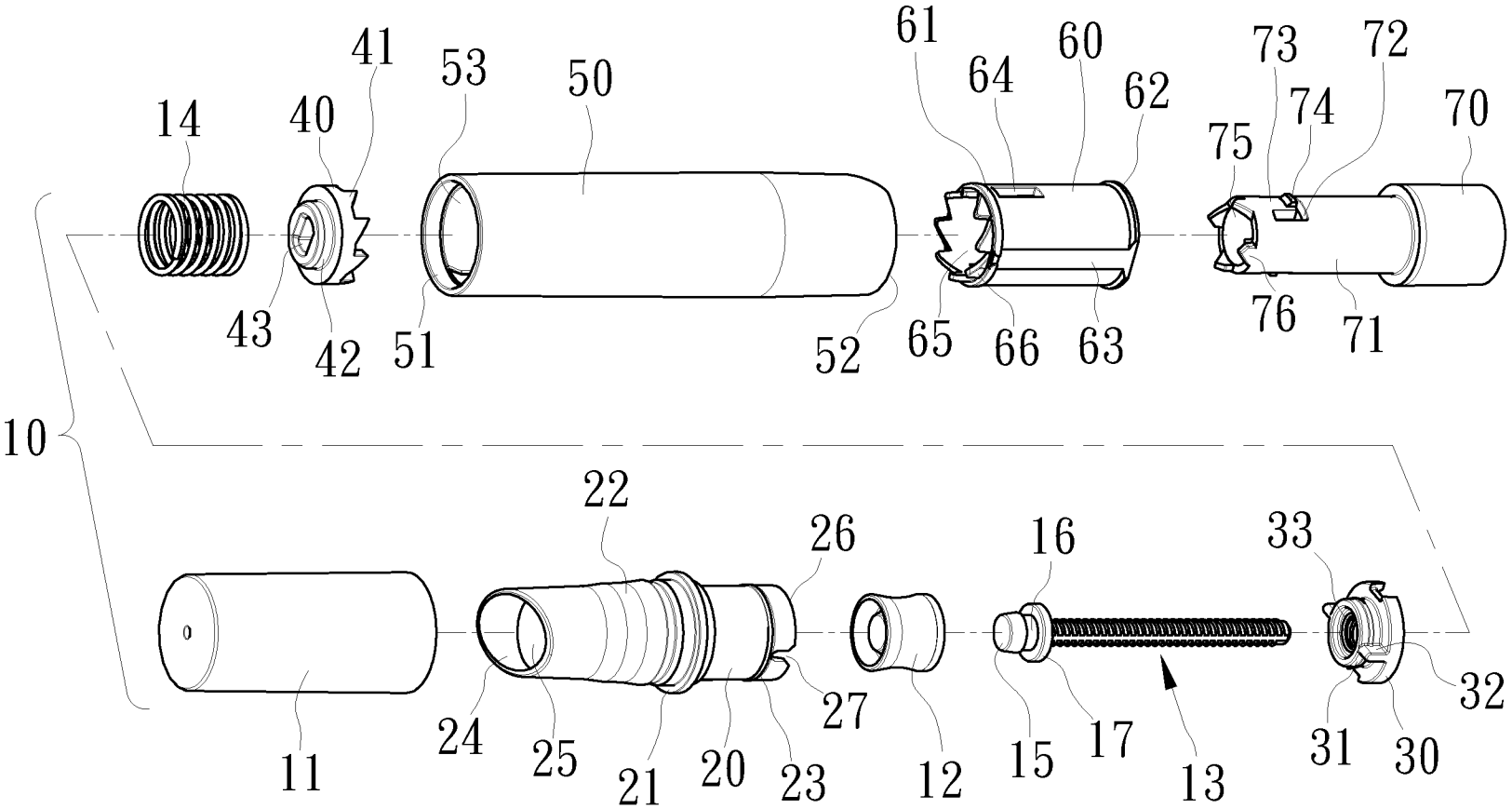
FIG. 1 is an exploded view of a cosmetic container according to the first embodiment of the present invention.

Referring to FIG. 1, a cosmetic container 10 includes a cap 11, a pusher 12, a threaded rod 13, a spring 14, a sleeve 20, a nut 31, a ratcheted wheel 40, a shell 50, a lining 60 and a button 70 according to a first embodiment of the present invention. The pusher 12 is allowed to translate in and along the sleeve 20. The nut 31 is connected to the sleeve 20 and inserted in the shell 50 so that they are not allowed to translate or rotate relative to one other. The threaded rod 13 is engaged with the nut 31. The shell 50 is connected to the sleeve 20 so that they are not allowed to translate or rotate relative to each other. The ratcheted wheel 40 is movably inserted in the shell 50. The spring 14 is compressed between the ratcheted wheel 40 and the nut 31. The lining 60 is inserted in the shell 50 so that they are not allowed to translate or rotate relative to each other. The button 70 is partially inserted in the lining 60 so that they are not rotatable but translatable relative to each other.

Figure 2:
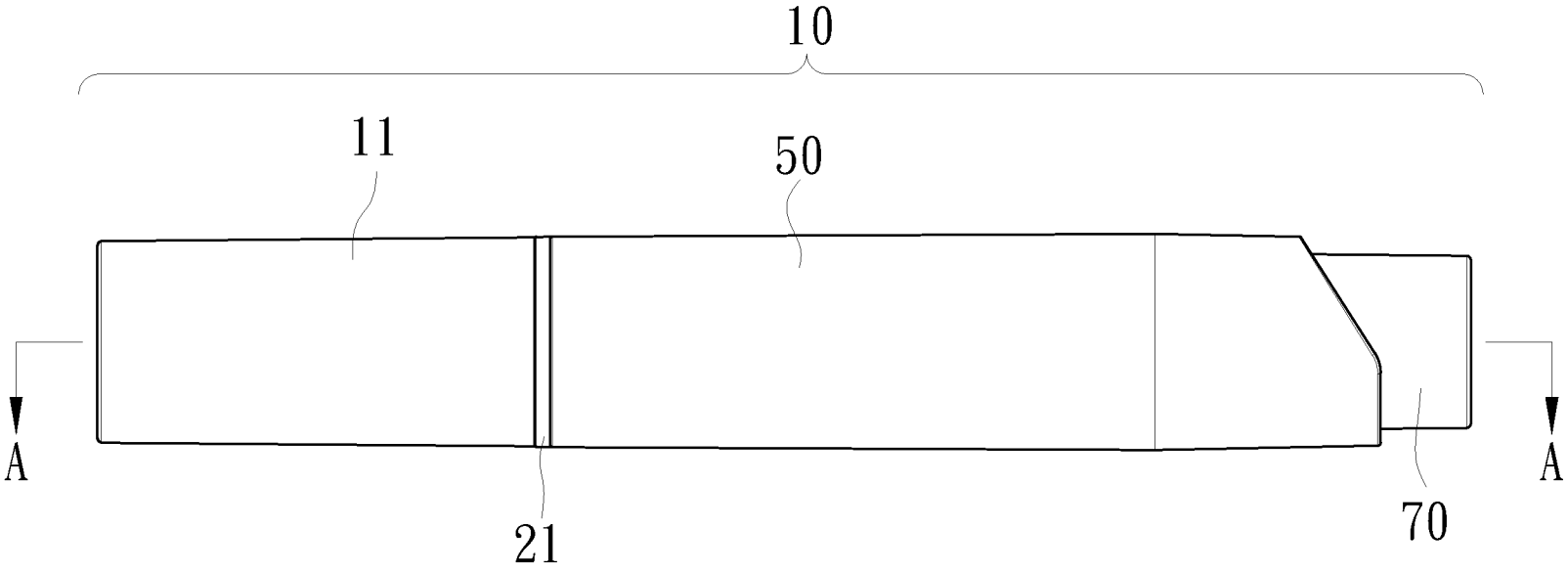
FIG. 2 is a side view of the cosmetic container shown in FIG. 1.

Referring to FIG. 2, the sleeve 20 includes a flange 21 formed between a front section and a rear section. The rear section of the sleeve 20 is fitted in the shell 50 so that a rear face of the flange 21 is in contact with a front end of the shell 50. The front section of the sleeve 20 can be covered by the cap 11 so that a front face of the flange 21 is in contact with a rear end of the cap 11. The button 70 includes a rear end extending from a rear end of the shell 50. The rear end of the button 70 can be pushed to extend a section of the cosmetic container 10 from the shell 50.

Figure 3:
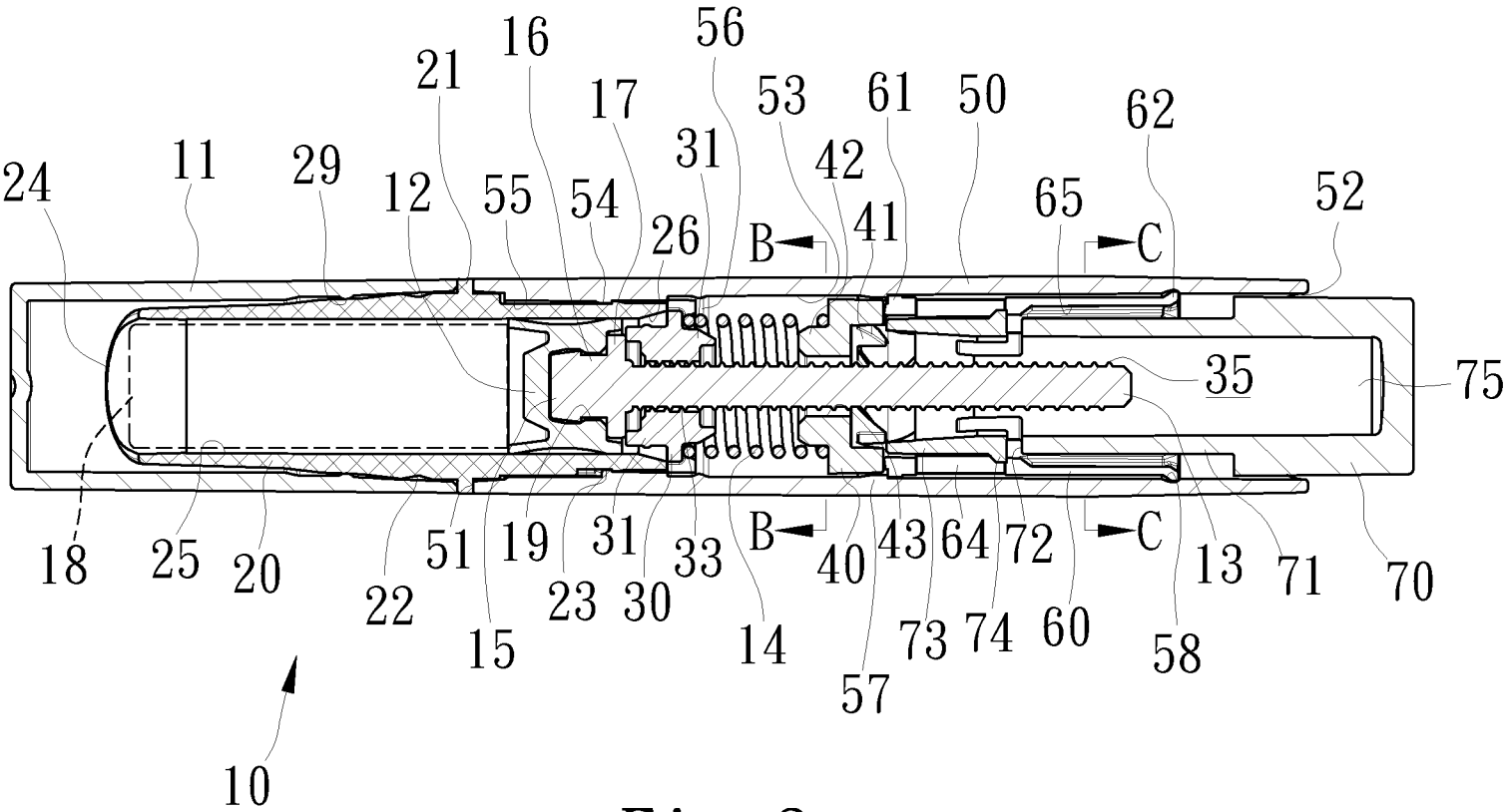
FIG. 3 is a cross-sectional view of the cosmetic container taken along a line A-A shown in FIG. 2.

Referring to FIGS. 1 and 3, the pusher 12 and the nut 31 are inserted in the rear section of the sleeve 20. The spring 14, the ratcheted wheel 40 and the lining 60 are inserted in chamber 53. A tube 71 extending forward from the button 70 is inserted in the lining 60. The threaded rod 13 is inserted in the pusher 12, the nut 31, the spring 14, the ratcheted wheel 40 and the tube 71.

The ratcheted wheel 40 includes ratchets 41 extending from a rear end or face, an axle 42 extending from a front end or face, and a non-circular aperture 43. The non-circular aperture 43 is made between two planar sides 46. There are six teeth 41 for example. Each of ratchets 41 includes a slope 44 and a vertical facet (not numbered).

The shell 50 includes a front opening 51 in a front end, a rear opening 52 in a rear end, and a chamber 53 in communication with both the openings 51 and 52. The shell 50 includes two annular ridges 54 and 57 on an internal face and an annular groove 58 in the internal face.

On an external face, the lining 60 includes a reinforce rib 61, an annular ridge 62 and two planar facets 63. The lining 60 includes two lateral slots 64, an axial tunnel 65 in communication with the slots 64, and ratchets 66 extending from a front end of the lining 60. There are six ratchets 66 for example. Each of the ratchets 66 includes a slope 67 (FIG. 8) and a vertical facet (not numbered).

The lining 60 is inserted in the chamber 53 through the rear opening 52. The reinforce rib 61 is in contact with the annular ridge 57. The annular ridge 62 is inserted in the annular groove 58. Thus, the lining 60 is kept in position longitudinally in the shell 50.

Figure 7:
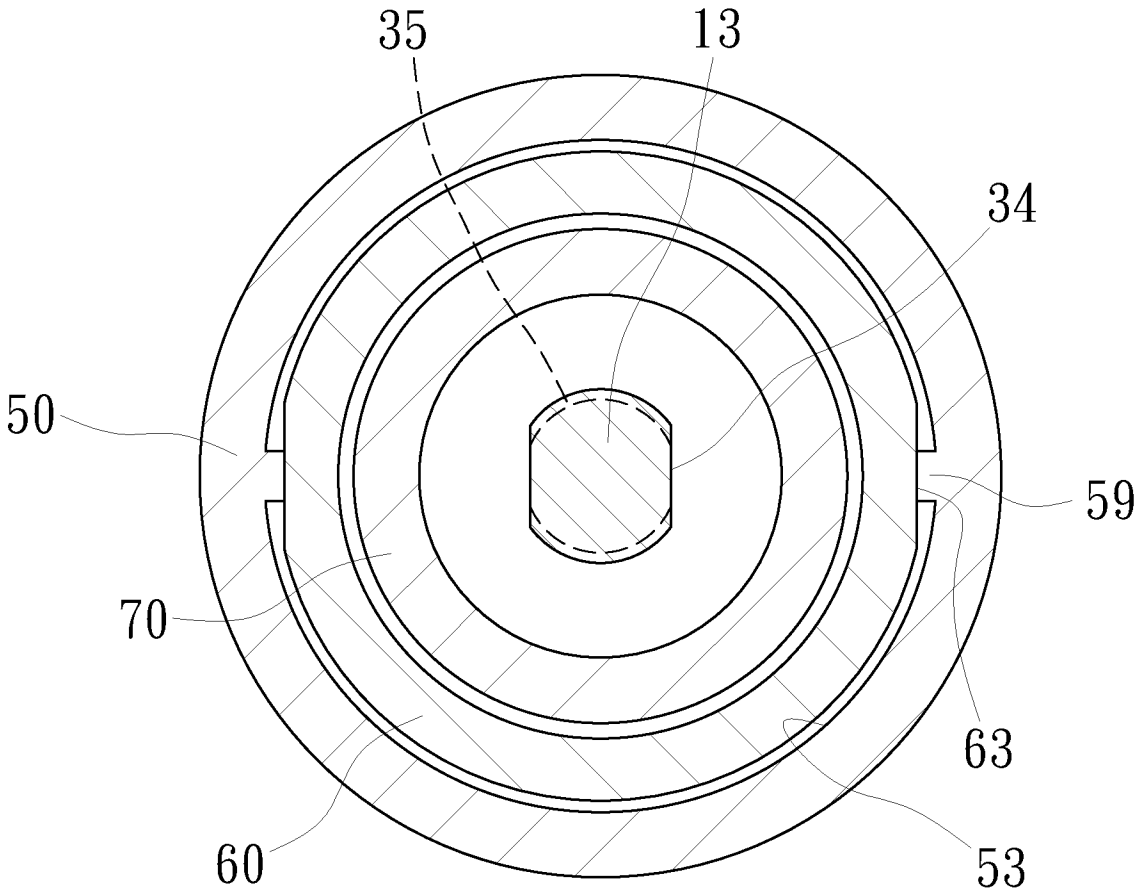
FIG. 7 is a cross-sectional view of the cosmetic container taken along a line C-C shown in FIG. 3.

Referring to FIG. 7 as well as FIGS. 1 and 3, two rectilinear ridges 59 extend from the internal face of the shell 50. The external face of the lining 60 includes two planar facets 63 in contact with the rectilinear ridges 59, thereby preventing the lining 60 from rotation in the shell 50.

The tube 71 of the button 70 includes an axial space 75. Two leaf springs 73 are formed by cutting two U-shaped slits 72 in the tube 71. A boss 74 transversely extends from a free end of each of the leaf springs 73. The tube 71 is inserted in the chamber 53 via the rear opening 52. Moreover, the tub 71 is inserted in the tunnel 65. The bosses 74 are movable in and along the slots 64. The movement of each of the bosses 74 is limited by two closed ends of the corresponding one of the slots 64. Thus, the tube 71 is kept in the lining 60 yet allowing the tube 71 to move in the lining 60.

Figure 9:
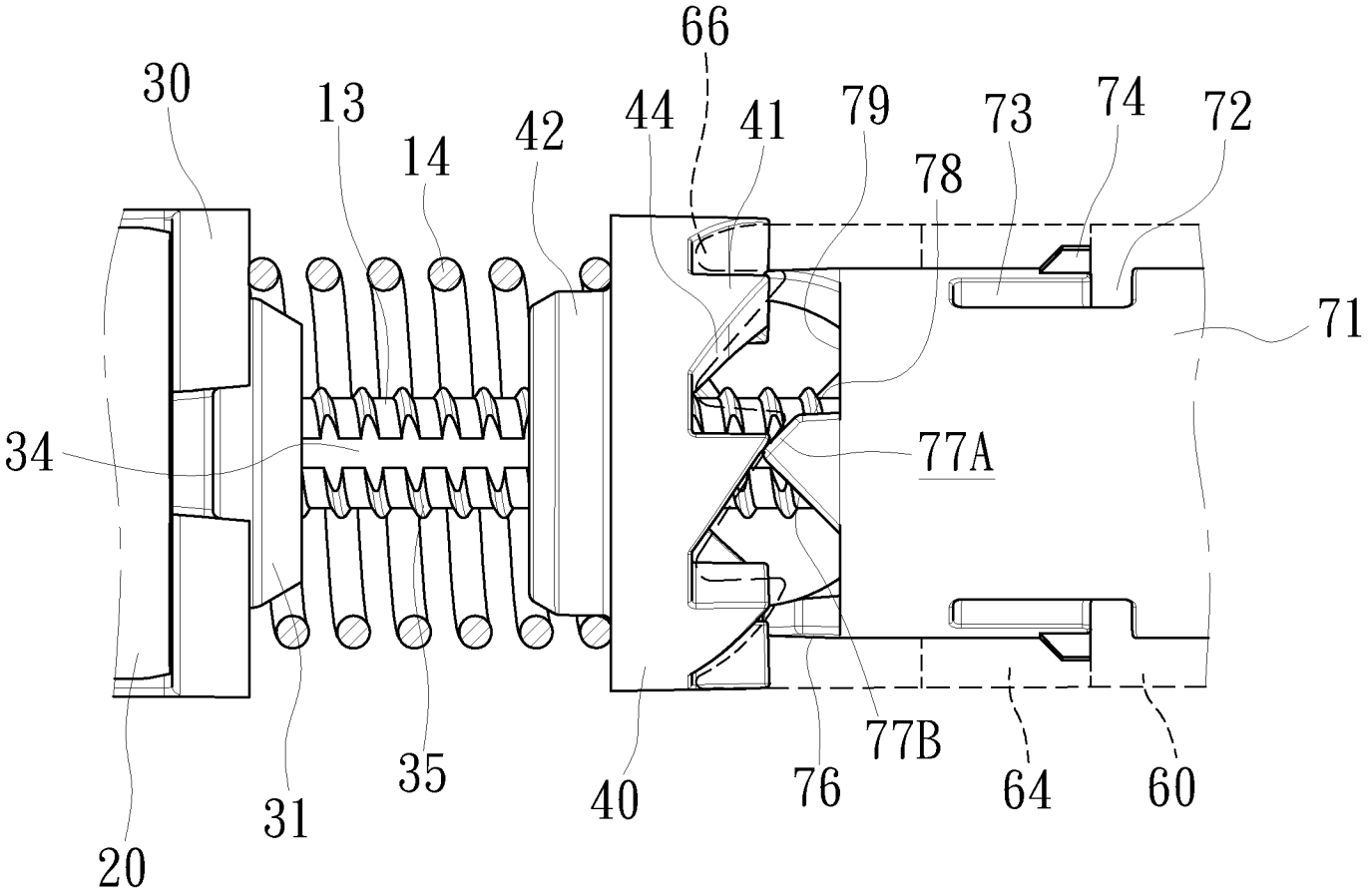
FIG. 9 is an enlarged partial view of the cosmetic container shown in FIG. 8.

Referring to FIGS. 1 and 9, teeth 76 extend from a front end of the tube 71. There are four teeth 76 for example. Each of the teeth 76 is formed with two slopes 77A and 77B and a vertical facet 78. The slope 77A extends shorter than the slope 77B. The vertical face 78 extends from the slope 77A. There is a gap 79 between any adjacent two of the teeth 76.

The sleeve 20 includes a rear section inserted in the chamber 53 via the front opening 51. The sleeve 20 includes a passageway 25 extending between an exit 24 and an entrance 26.

The cap 11 is used to cover an exit 24 of the sleeve 20. On an internal face, the cap 11 includes an annular ridge 29 in contact with a conical face 22 of the sleeve 20.

The nut 31 includes a flange 30 extending around a rear section of the nut 31, two fins 32 extending in a radial manner from a front section of the nut 31, and an internal thread 33 extending on an internal face of the nut 31. The nut 31 is inserted the passageway 25 via the entrance 26. The flange 30 closes the entrance 26. Referring to FIG. 7, the fins 32 are inserted in two cutouts 27 made in a rear annular edge of the sleeve 20 to prevent the nut 31 from rotation relative to the sleeve 20.

The threaded rod 13 includes an annular groove 16 between a head 15 and a flange 17. Preferably, the head 15, the annular groove 16 and the flange 17 are different portions of a single element that is connected to the threaded rod 13.

Figure 6:
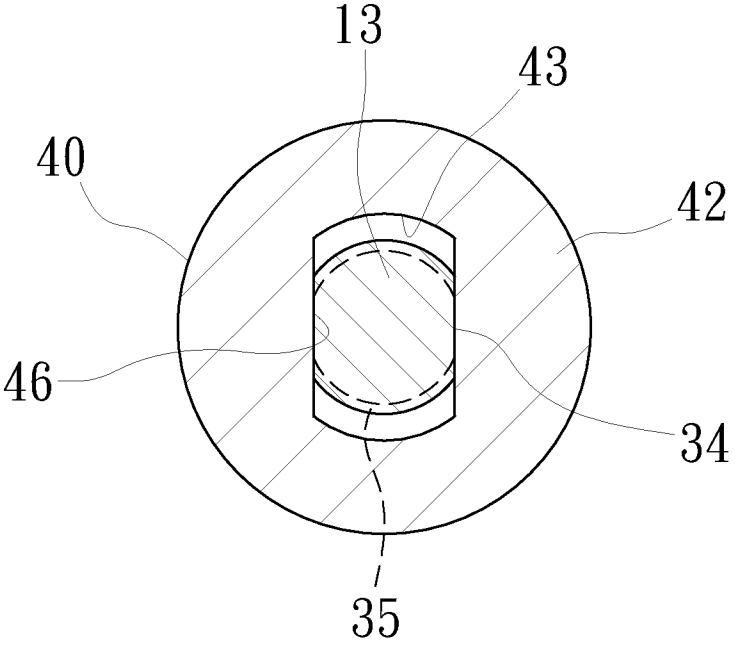
FIG. 6 is a cross-sectional view of the cosmetic container taken along a line B-B shown in FIG. 3.

A thread 35 of the threaded rod 13 is engaged with the internal thread 33 of the nut 31. The insertion of the threaded rod 13 into the nut 31 is stopped when the flange 17 is in contact with a front end of the nut 31. The threaded rod 13 is inserted in a non-circular aperture 43 of the ratcheted wheel 40 and a space 75 of the tube 71. The threaded rod 13 is formed with two planar faces 34 (FIG. 6). The planar faces 34 are in contact with the planar sides 46 so that the threaded rod 13 is rotatable together with the ratcheted wheel 40. That is, the ratcheted wheel 40 is rotatable to rotate the threaded rod 13 synchronously. The head 15 is inserted in a tunnel 19 in the pusher 12. The annular groove 16 receives an annular ridge (not numbered) extending from the wall of the tunnel 19. The flange 17 closes the tunnel 19. The pusher 12 is operable to push a cosmetic product 18 such as a lipstick toward an exit 24 of the sleeve 20.

The axle 42 is inserted in a rear end of the spring 14 while the rear section of the nut 31 is inserted in a front end of the spring 14. As mentioned above, the spring 14 is compressed between the nut 31 and the ratcheted wheel 40 so that the ratchets 41 are elastically engaged with the ratchets 66. That is, the spring 14, the ratcheted wheel 40 and the lining 60 together become a clutch.

Figure 4:
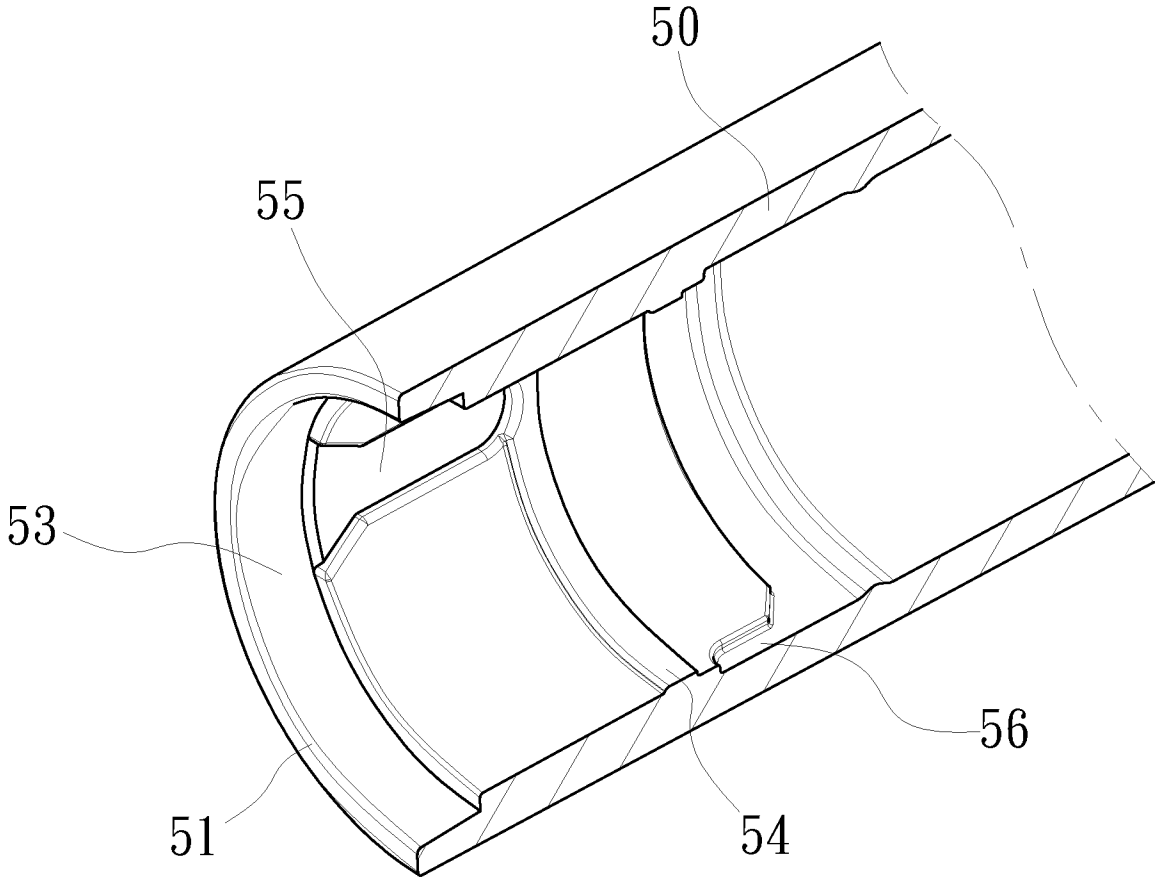
FIG. 4 is an enlarged partial cut-away view of a shell of the cosmetic container shown in FIG. 2.

Referring to FIG. 4, in the internal face, the shell 50 further includes two front rectilinear groove 55 and two rear rectilinear grooves 56. The front rectilinear grooves 55 extend to the first annular ridge 54 from the front opening 51. The rear rectilinear grooves 56 extend from another side of the first annular ridge 54.

Figure 5:
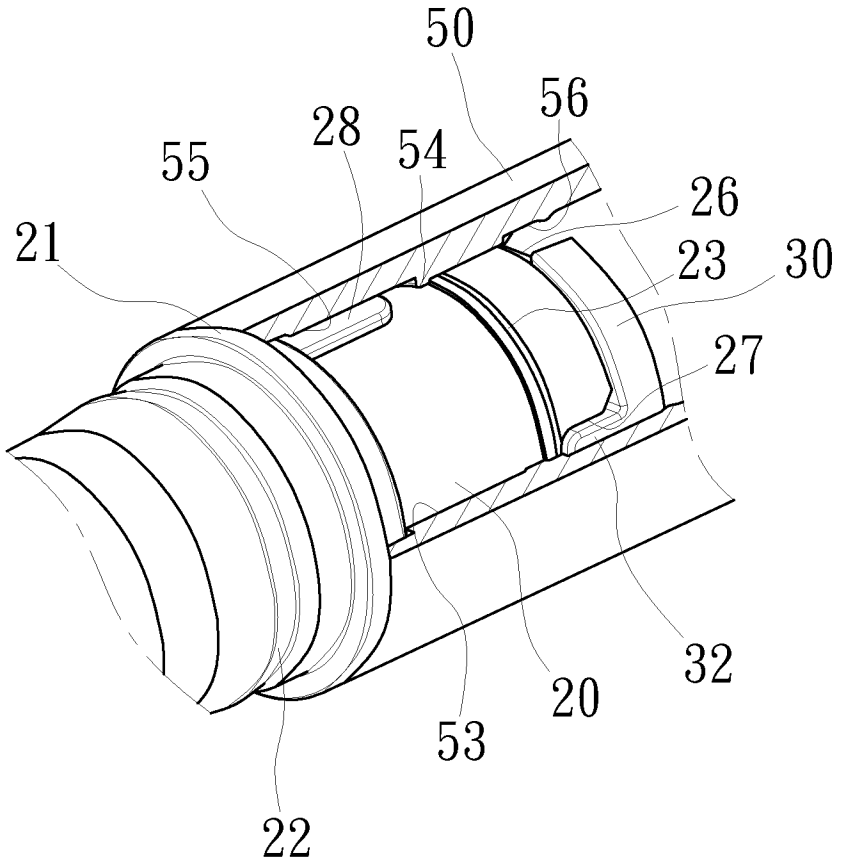
FIG. 5 is an enlarged partial cut-away view of the cosmetic container shown in FIG. 2.

Referring to FIG. 5, the flange 21 covers the front opening 51, the first annular ridge 54 abuts against the annular ridge 23 to keep the sleeve 20 in the shell 50. The front rectilinear grooves 55 receive two rectilinear ridges 28 extending from the sleeve 20 to prevent the sleeve 20 from rotation relative to the shell 50. The rear rectilinear grooves 56 receive the fins 32 to prevent the nut 31 from rotation relative to the shell 50.

Figure 8:
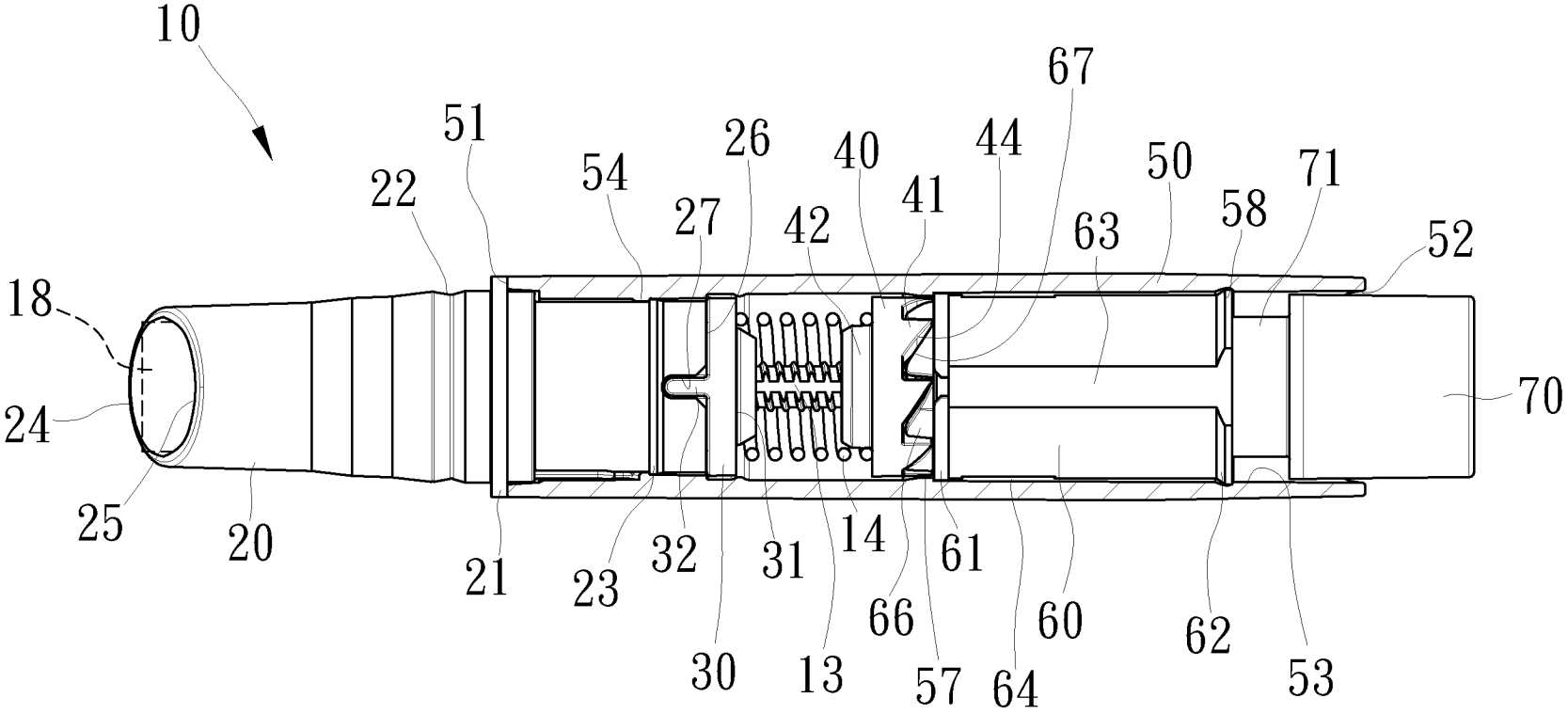
FIG. 8 is another cross-sectional view of the cosmetic container shown in FIG. 2.

Referring to FIGS. 8 and 9, the button 70 is not pushed. The ratchets 41 are engaged with the ratchets 66 (FIG. 8) so that the ratcheted wheel 40 is not rotatable relative to the lining 60. Two opposite ones of the ratchets 41 are engaged with two opposite ones of the teeth 76.

Figure 10:
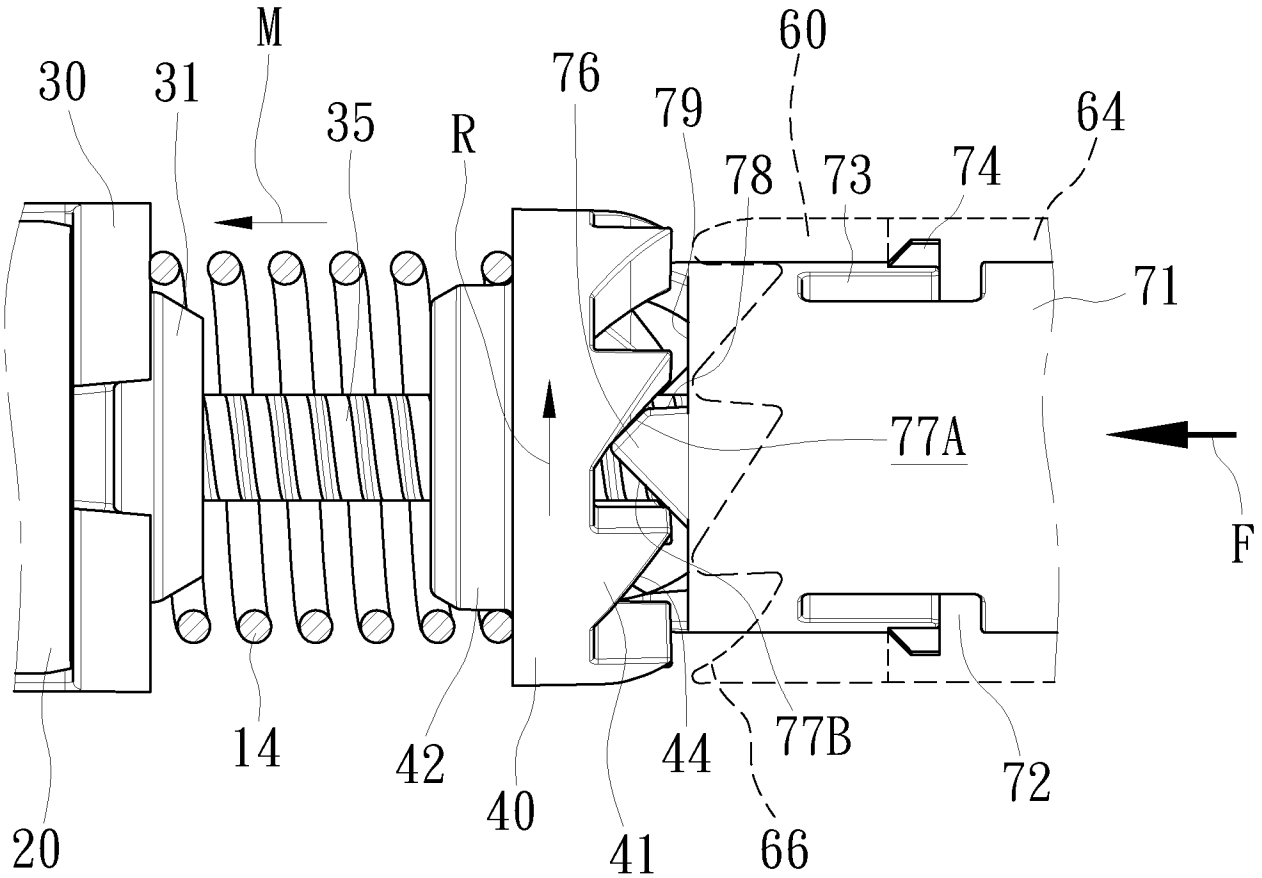
FIG. 10 is an enlarged partial view of the cosmetic container in another position than shown in FIG. 9.

Referring to FIG. 10, the button 70 is pushed as indicated by an arrow head F. The teeth 76 translate and hence disengage the ratchets 41 from the ratchets 66. The slopes 44 slide on the slopes 77A, thereby rotating the ratcheted wheel 40 indicated by an arrow head R. The ratcheted wheel 40 rotates the threaded rod 13 relative to the nut 31 so that the threaded rod 13 is translated relative to the nut 31 as indicated by an arrow head M. Hence, the pusher 12, which is connected to the threaded rod 13, extends the cosmetic product 18 from the sleeve 20.

Referring to FIG. 8, the button 70 is released, i.e., not pushed. The spring 14 pushes the ratcheted wheel 40 which pushes the tube 71. Hence, the button 70 is pushed from the shell 50. Then, the ratchets 41 are engaged with the ratchets 66.

As discussed above, every time the button 70 is pushed, the ratcheted wheel 40 is rotated for a constant angle. Due to the insertion in the non-circular aperture 43, the non-circular threaded rod 13 is rotated for the same angle. For the engagement with the nut 31, the threaded rod 13 is translated for a constant distance, and so is the pusher 12. Hence, the cosmetic product 18 is extended from the sleeve 20 for the same distance.

Figure 11:
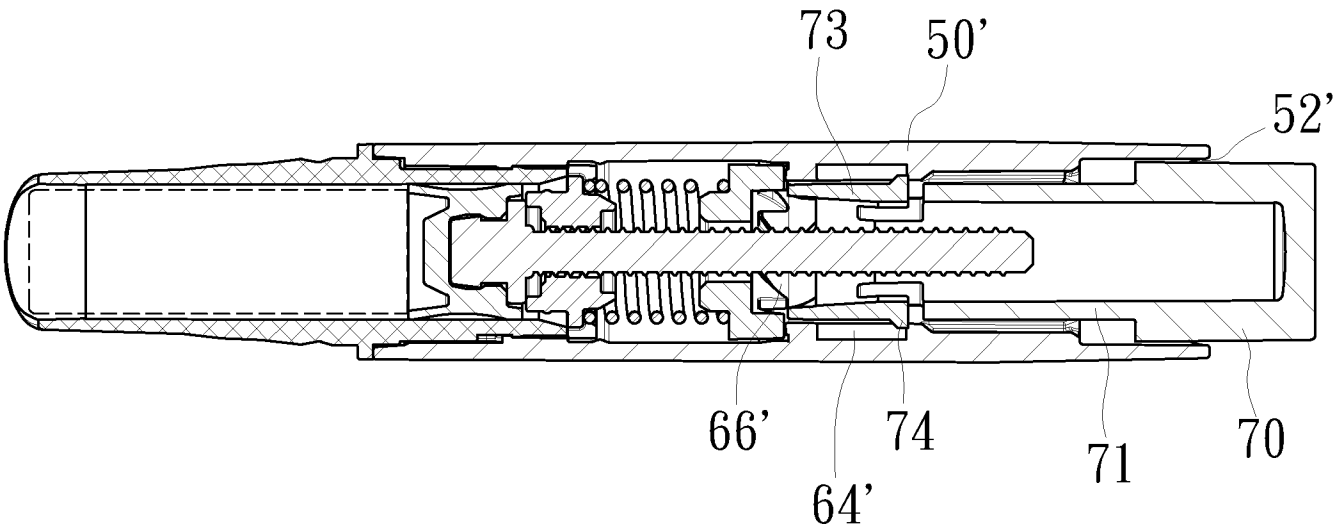
FIG. 11 is a cross-sectional view of a cosmetic container according to the second embodiment of the present invention.

Referring to FIG. 11, there is a cosmetic container according to a second embodiment of the present invention. The second embodiment is like the first embodiment except for using a shell 50' instead of the shell 50. The shell 50' is actually a combination of the shell 50 with the lining 60. The tube 71 is inserted in the shell 50' so that the rear end of the button 70 extends out of the shell 50' via a rear opening 52'. Instead of the slots 64, two grooves 64' are used to receive the bosses 74. Instead of the ratchets 66, ratchets 66' of the shell 50' are elastically engaged with the ratchets 41 of the ratcheted wheel.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A cosmetic container comprising:

a shell formed with an internal face;

stationary ratchets attached to the internal face of the shell;

a sleeve non-movably connected to the shell;

a nut non-movably inserted in the shell;

a non-circular threaded rod engaged with the nut;

a ratcheted wheel movable in the shell and comprising:

a non-circular aperture for receiving the non-circular threaded rod so that the ratcheted wheel is not rotatable but translatable relative to the non-circular threaded rod; and ratchets engageable with the stationary ratchets; and a button comprising a tube not rotatable but translatable in the shell and teeth formed at an end of the tube and engaged with the ratchets of the ratcheted wheel, wherein every time the button is pushed, the teeth push and disengage the ratchets of the ratcheted wheel from the stationary ratchets to allow the teeth of the ratcheted wheel to slide on the teeth so that the ratcheted wheel is translated and rotated in the shell, thereby rotating and translating the non-circular threaded rod relative to the nut to extend a cosmetic product from the sleeve.

2. The cosmetic container according to claim 1, wherein the shell and the stationary ratchets are made in one piece.

3. The cosmetic container according to claim 1, further comprising a lining non-movably inserted in the shell, wherein the stationary ratchets are formed at an end of the lining.

4. The cosmetic container according to claim 3, wherein the shell comprising an annular groove in the internal face, wherein the lining comprises an annular ridge inserted in the annular groove.

5. The cosmetic container according to claim 3, wherein the shell comprises an annular ridge, wherein the lining comprises a reinforce rib in contact with the annular ridge.

6. The cosmetic container according to claim 3, wherein the shell comprises a rectilinear ridge formed on the internal face, wherein the lining comprises a planar facet in contact with the rectilinear ridge.

7. The cosmetic container according to claim 1, further comprising a slot in the internal face of the shell, wherein the tube comprises a boss translatable in an along the slot.

8. The cosmetic container according to claim 7, further comprising a lining non-movably inserted in the shell, wherein the slot is made in the lining.

9. The cosmetic container according to claim 8, wherein the tube is formed with a leaf spring, wherein the boss is formed on the leaf spring.

10. The cosmetic container according to claim 7, wherein the shell comprising an annular groove in the internal face, wherein the lining comprises an annular ridge inserted in the annular groove.

11. The cosmetic container according to claim 7, wherein the shell comprises an annular ridge, wherein the lining comprises a reinforce rib in contact with the annular ridge.

12. The cosmetic container according to claim 7, wherein the shell comprises a rectilinear ridge formed on the internal face, wherein the lining comprises a planar facet in contact with the rectilinear ridge.

13. The cosmetic container according to claim 1, wherein the non-circular threaded rod comprises a planar face, wherein the non-circular aperture comprises a side in contact with the planar face.

14. The cosmetic container according to claim 1, further comprising a spring compressed between the nut and the ratcheted wheel.

15. The cosmetic container according to claim 1, further comprising a pusher connected to an end of the threaded rod, wherein the pusher is in contact with the cosmetic product.

* * * * *